US008453628B2

(12) United States Patent
Mueller

(10) Patent No.: US 8,453,628 B2
(45) Date of Patent: Jun. 4, 2013

(54) METHOD FOR GENERATING CORONA DISCHARGES IN TWO COMBUSTION CHAMBERS OF A COMBUSTION ENGINE

(75) Inventor: Markus Mueller, Neuenstein (DE)

(73) Assignee: BorgWarner BERU Systems GmbH, Ludwigsburg (DE)

( * ) Notice: Subject to any disclaimer, the term of this patent is extended or adjusted under 35 U.S.C. 154(b) by 0 days.

(21) Appl. No.: 13/223,503

(22) Filed: Sep. 1, 2011

(65) Prior Publication Data

US 2012/0055456 A1 Mar. 8, 2012

(30) Foreign Application Priority Data

Sep. 4, 2010 (DE) ..... 10 2010 045 174

(51) Int. Cl.
*F02P 3/04* (2006.01)

(52) U.S. Cl.
USPC ..... 123/606; 123/608; 123/649; 123/143 B

(58) Field of Classification Search
USPC ..... 123/143 B, 606, 608, 649
See application file for complete search history.

(56) References Cited

U.S. PATENT DOCUMENTS

| | | | | |
|---|---|---|---|---|
| 4,567,874 | A * | 2/1986 | Rouanes | 123/606 |
| 4,825,844 | A * | 5/1989 | Fasola | 123/643 |
| 4,998,526 | A | 3/1991 | Gokhale | |
| 5,438,971 | A | 8/1995 | Murata et al. | |
| 5,510,952 | A * | 4/1996 | Bonavia et al. | 361/251 |
| 6,135,099 | A | 10/2000 | Marrs et al. | |
| 6,603,216 | B2 * | 8/2003 | Costello | 290/41 |
| 2010/0147239 | A1 * | 6/2010 | Lu et al. | 123/169 R |

FOREIGN PATENT DOCUMENTS

| | | |
|---|---|---|
| WO | WO 2004/063560 A1 | 7/2004 |
| WO | WO 2010/011838 A1 | 1/2010 |

* cited by examiner

*Primary Examiner* — Erick Solis

(57) ABSTRACT

The invention describes a method for generating corona discharges in two combustion chambers of a combustion engine, into each of which a high-frequency igniter (HFZ3, HFZ4) protrudes which is part of a high-frequency resonant circuit, by providing only one single transformer (TR4), which has a primary side and a secondary side, at least one primary winding on the primary side and a secondary winding on the secondary side, connecting the secondary winding of the transformer (TR3, TR4) to both resonant circuits and feeding into both resonant circuits the high frequency alternate current flowing through the secondary winding.

5 Claims, 2 Drawing Sheets

METHOD FOR GENERATING CORONA DISCHARGES IN TWO COMBUSTION CHAMBERS OF A COMBUSTION ENGINE

The invention concerns the use of a transformer, which has at least one primary winding and a secondary winding, for generating corona discharges in a combustion chamber of a combustion engine, into each of which a high-frequency igniter protrudes, which is part of a high-frequency resonant circuit, which is connected to the secondary winding of the transformer and is fed with the high frequency alternate current flowing through the secondary winding.

WO 2010/011838 A1 and WO 2004/063560 A1 disclose how a fuel-air-mixture can be ignited in a combustion chamber of a combustion engine by means of a corona discharge generated in the combustion chamber. For this purpose, an ignition electrode is extends through one of the walls of the combustion chamber, which is at ground potential with an electrical insulation and protrudes into the combustion chamber, preferably opposite to a piston provided in the combustion chamber. The ignition electrode forms a capacitance together with the walls of the combustion chamber at ground potential as a counter electrode. The combustion space with its content acts as a dielectric. According to the cycle of the piston, said combustion space contains air or a fuel-air-mixture or an exhaust gas.

The capacitance is an integral part of an electrical resonant circuit, which is energised with a high frequency voltage, which is generated in prior art by means of a transformer having a centre tap (also designated as centre tapping). The transformer co-operates with a switching device, which applies a predefinable D.C. voltage to both primary windings of the transformer connected by the centre tap. The centre tap is constantly at an electrical potential different from the ground potential while the ends of both primary windings remote from the centre tap are alternately connected to ground. The secondary winding of the transformer feeds a series resonant circuit comprising the capacitance that is formed by the ignition electrode, the insulator, possibly an outer conductor enclosing the insulator, and the walls of the combustion chamber. The resonant circuit may also comprise inductances and ohmic resistances in series with the capacitance. The frequency of the alternate voltage energising the resonant circuit and delivered by the transformer is controlled in prior art in such a way, that it is as close as possible to the resonance frequency of the resonant circuit. The result is a voltage overshoot between the ignition electrode and the walls of the combustion chamber, in which the igniter is arranged. The resonance frequency ranges typically between 30 kHz and 3 MHz and the alternate voltage reaches values of for instance 50 kV to 500 kV at the ignition electrode.

A corona discharge can hence be generated in the combustion chamber. The corona discharge should not turn into an arc discharge or a spark discharge. It is therefore ensured that the voltage between the ignition electrode and the ground remains below the voltage designed for a complete breakthrough.

Every combustion chamber of a combustion engine requires its own igniter which generates a corona discharge at an individually selectable ignition timing and is energised in this view by means of its own transformer.

An object of the present invention is to reduce the amount of equipment which is required for providing such a HF ignition system for a combustion engine.

SUMMARY OF THE INVENTION

According to the invention only a single transformer is used for generating corona discharges in two combustion chambers of a combustion engine, into each of which a high-frequency igniter protrudes. The igniter usually comprises an ignition electrode and an electrical insulator that encloses the ignition electrode and insulates it with respect to the walls of the respective combustion chamber. The transformer has at least one primary winding and a secondary winding. The igniter is integral part of a high-frequency resonant circuit, which is connected to the secondary winding of a transformer and is fed with the high frequency alternate current flowing through the secondary winding.

This has significant advantages:

- A transformer is completely saved for each two combustion chambers or cylinders of a combustion engine.
- With each saved transformer, circuit components for controlling the transformer on its primary side and feeding it with D.C. voltage signals are also saved.
- In spite of said savings, the functionality achieved in prior art with the use of one transformer for each combustion chamber or for each cylinder of a combustion engine, is fully preserved.
- The aforementioned savings enable to reduce the costs for the HF ignition system of a combustion engine accordingly.
- The aforementioned savings enable to reduce the space requirements for the ignition system. This is a significant advantage because the spaces in the engine bay of a vehicle are usually quite restricted.
- The aforementioned savings also enable to reduce the weight.
- The additional cost, which is required for connecting the secondary winding of a transformer alternately with two different high frequency igniters is comparatively small.
- Although the transformer is used according to the invention alternately for two different igniters, this need not cause a significant rise in price of the transformer. Though the core of the transformer may be exposed to a magnetic power flux only up to a certain limit, so that the core material does not reach magnetic saturation. The magnetic flux which occurs in of the core material at the expected peak performance should therefore be smaller than the admissible limit for the core material. But since the ignition of the fuel-air-mixture in the different combustion chambers of a combustion engine usually does not take place simultaneously any transformer can always be allocated to two igniters, which never have to ignite at the same time. The core of the transformer therefore need not be adapted to a higher peak performance, even when the transformer does not operate only one, but rather two igniters. Only with the windings of the transformer may an adaptation to the increased load be necessary, which occurs in the transformer when operating two HF igniters with a single transformer, because twice the power loss accrues in the windings.

Preferably, a transformer is used that is fed with DC pulses on its primary side, which alternately have a positive and a negative polarity for generating the high frequency alternate current flowing in the secondary winding. It is intended that D.C. pulses of the same polarity are generated with a frequency which matches the resonance frequency of the high-frequency resonant circuit on the secondary side of the transformer or is close to the resonance frequency. This leads to a maximum resonance rise of the secondary voltage and creates the best conditions for an ignition by means of a high frequency corona discharge.

Preferably a transformer is used that has two primary windings, which are connected to one another at one of their ends by a common centre tap, which is constantly connected to one of two poles of a D.C. voltage source. The other ends of the primary windings are connected alternately to the other pole of the D.C. voltage source, for which purpose a high frequency change-over switch is provided between the D.C. voltage source and both other ends of the primary windings. The switch may be a semiconductor based power switch, e. g. a MOSFET. A direct current provided by the D.C. voltage source then flows through the primary windings in opposite directions. Thereby the desired alternate voltage is induced in the secondary winding of the transformer.

It is possible to use a transformer with only one primary winding and to connect the D.C. voltage source with alternating polarity to the ends of the single primary winding, for instance using a H bridge circuit.

The secondary winding of the transformer is alternately connected to one or to the other of two igniters, so that the latter alternately cause an ignition by means of a corona discharge. Preferably both igniters, which are allocated to a common transformer and are supplied from this transformer with the necessary high frequency alternate voltage, are adapted such that their ignition timings in the combustion engine occur with the longest possible time intervals. The time interval is advantageously specified as the rotational angle difference of a crankshaft of the combustion engine, because this specification is independent of the rotation speed of the engine. Since vehicle motors usually have an even number of cylinders, any two cylinders or the HF igniters provided in the cylinders having a sufficiently high angular difference of the crankshaft can always be combined to constitute a pair and be allocated to a common transformer.

BRIEF DESCRIPTION OF THE DRAWINGS

The accompanying figures provide better explanation of the invention.

DETAILED DESCRIPTION

Figure 1:
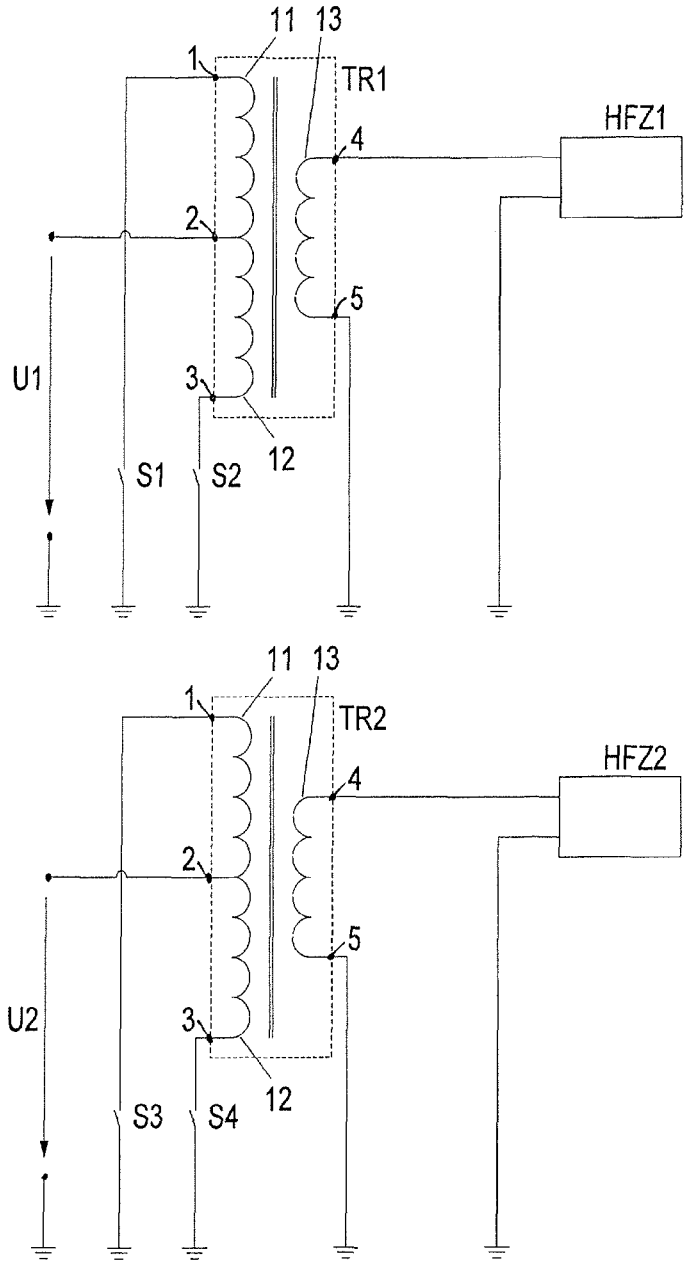
FIG. 1 shows how two high frequency igniters are fed from one transformer each according to prior art.

The circuit diagram shown in FIG. 1 shows a first high frequency igniter HFZ1 and a second high frequency igniter HFZ2. The first high frequency igniter HFZ1 is connected to the secondary winding 13 of a first transformer TR1 via ports 4 and 5. The transformer TR1 has two primary windings 11 and 12 with a common centre tap 2, which is constantly connected to one and the same pole of a voltage source U1. Both other ends 1 and 3 of the primary windings 11 and 12 can be connected to ground alternately using the high frequency switches S1 and S2.

Likewise, the high frequency igniter HFZ2 is connected to a second transformer TR2, which also has two primary windings 11 and 12 with a common centre tapping 2, which is constantly connected to one and the same pole of a voltage source U2. Both other ends of the primary windings 11 and 12 can be connected to ground alternately using the high frequency switches S3 and S4. The high frequency igniters HFZ1 and HFZ2 are operated independently from one another by the high frequency switches S1 and S2 respectively S3 and S4.

Figure 2:
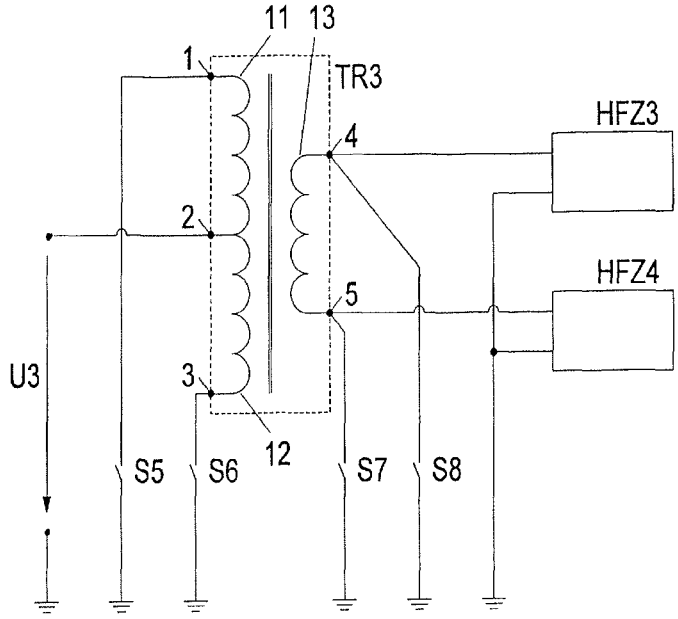
FIG. 2 shows how two high frequency igniters can be fed by a common transformer and FIG. 3 shows how a high frequency igniter can be fed from a transformer, that has only one winding on its primary side and is operated via a H bridge.

The circuit diagram represented in FIG. 2 differs from the circuit diagram shown in FIG. 1 in that that the secondary winding is connected to two high frequency igniters HFZ3 and HFZ4 with its ports 4 and 5 and can be connected to ground via the switches S7 and S8. The switches S7 and S8 connect according to which igniter should be operated. For actuation of the high frequency igniter HFZ3 port 5 of the secondary winding 13 is connected to ground via the switch S7. For actuation of the high frequency igniter HFZ4 port 4 of the secondary winding 13 is connected to ground via the switch S8. As in the example of FIG. 1, the primary side of the transformer TR3 has two primary windings 11 and 12, whose centre tap 2 is constantly connected to the same pole of a voltage source U3, whereas both other ends 1 and 2 of the primary windings 11 and 12 can be connected to ground alternately using the high frequency switches S5 and S6.

Figure 3:
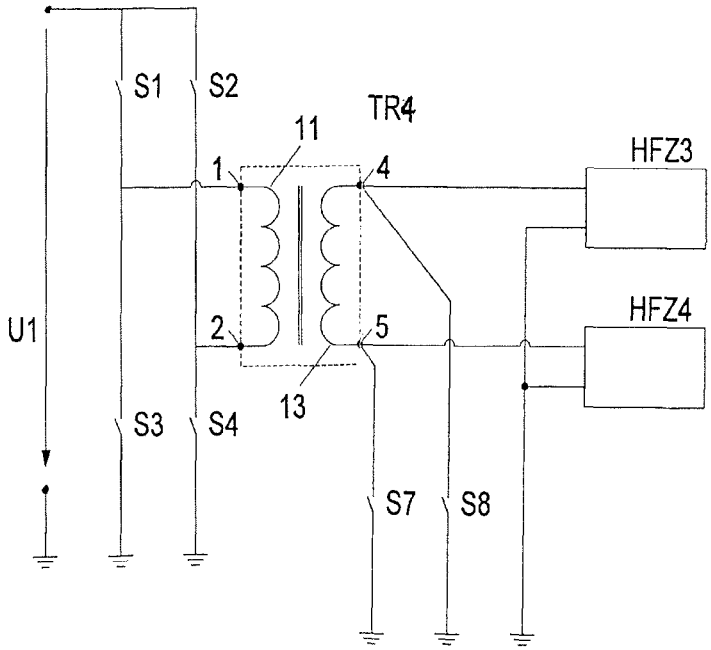

The circuit diagram shown in FIG. 3 illustrates by way of example the actuation of a high frequency igniter HFZ1 by means of a transformer TR4, that has only one primary winding 11 and is operated via a H bridge circuit which has four high-frequency power switches S1 to S4. The current flows in the primary winding 11 alternately in one or the other direction. For this purpose, either the power switches S1 and S4 or the power switches S2 and S3 are closed and more precisely alternately in pairs. Two high frequency igniters HFZ3 and HFZ4 are connected to the secondary winding 13 of the transformer TR4 as in the circuit diagram of FIG. 2.

The high frequency switches S1 to S6 can be of equal design. The voltage sources U1, U2 and U3 should deliver the same D.C. voltage.

REFERENCE NUMBERS

1. End of a primary winding
2. Centre tap
3. End of a primary winding
4. Port of the secondary winding
5. Port of the secondary winding
11. Primary winding
12. Primary winding
13. Secondary winding
TR1 to TR4 Transformers
HFZ1 to HFZ4 High frequency igniters
S1 to S6 High frequency switches on the primary side of the transformers
S7, S8 High frequency switches on the secondary side of the transformers TR3
U1 to U3 Voltage source

What is claimed is:

1. A method for generating corona discharges in two combustion chambers of a combustion engine, into each of which a high-frequency igniter (HFZ3, HFZ4) protrudes which is part of a high-frequency resonant circuit, the method comprising:

providing only one single transformer (TR4), having a primary side and a secondary side, with at least one primary winding on the primary side and a secondary winding on the secondary side, connecting the secondary winding of the transformer (TR3, TR4) the resonant circuits; and feeding into the resonant circuits high frequency alternate current flowing through the secondary winding.

2. The method according to claim 1, wherein the transformer (TR3, TR4) is fed with D.C. pulses on the primary side, said D.C. pulses alternately having a positive and a negative polarity for generating the high frequency alternate current flowing in the secondary winding.

3. The method according to claim 1, wherein the transformer (TR3) is provided with two primary windings, the primary winding connected to one another on one end thereof by a common centre tap, constantly connected to one of two poles of a D.C. voltage source (U3), and wherein the other ends of the primary windings are connected alternately to an other pole of the D.C. voltage source (U3).

4. The method according to claim 1, wherein the transformer (TR3, TR4) is connected to both high-frequency igniters (HFZ3, HFZ4) via the secondary winding and both high-frequency igniters (HFZ3, HFZ4) are alternately fed with said high frequency alternate current flowing through the secondary winding.

5. The method according to claim 1, wherein the igniters (HFZ3, HFZ4) connected to the transformer (TR3) are operated separately.

* * * * *